US006178696B1

(12) United States Patent
Liang

(10) Patent No.: US 6,178,696 B1
(45) Date of Patent: Jan. 30, 2001

(54) WINDOW SASH LATCH

(76) Inventor: Kun Liang, 7 Tulip Dr., Glen Cove, NY (US) 11542

( * ) Notice: Under 35 U.S.C. 154(b), the term of this patent shall be extended for 0 days.

(21) Appl. No.: 09/430,257

(22) Filed: Oct. 29, 1999

(51) Int. Cl.[7] ..... E05D 15/22

(52) U.S. Cl. ..... 49/185; 49/183

(58) Field of Search ..... 49/183, 184, 185, 49/176, 163, 449; 292/174, 175, DIG. 63, DIG. 37

(56) References Cited

U.S. PATENT DOCUMENTS

| | | | | |
|---|---|---|---|---|
| 2,768,852 | * | 10/1956 | Hicks | 292/175 |
| 4,837,975 | * | 6/1989 | Simpson | 292/175 X |
| 4,995,649 | * | 2/1991 | Magnusson | 292/175 |
| 5,127,685 | * | 7/1992 | Dallaire et al. | 49/185 X |
| 5,669,639 | * | 9/1997 | Lawrence | 292/175 |
| 5,671,958 | * | 9/1997 | Szapucki et al. | 292/175 |
| 6,021,603 | * | 2/2000 | Prete et al. | 49/183 |

* cited by examiner

*Primary Examiner*—Jerry Redman

(74) *Attorney, Agent, or Firm*—Thomas A. O'Rourke; Wyatt Gerber & O'Rourke

(57) ABSTRACT

Disclosed is an improved window sash latch for use in a pivotal window sash adapted for installation in a master frame of a double-hung sash window assembly. The latch has a housing having a top wall having an access opening therethrough, a pair of opposing side walls and a single end wall extending between the side walls. Each of said side walls and the end wall extend from said top wall and have a free end opposite the top wall. There is a latch bolt slidably received in the housing and having a top wall, two opposing side walls and two opposing end walls. Each of the side walls and each of the end walls extend from said top wall and have a free end opposite said top wall. The first end wall is generally perpendicular to each of the side walls. The second end wall forms a beveled end arranged to be engaged in a guide rail for locking the window sash against pivotal movement. The first end wall has one surface on the interior of the latch bolt and a second surface on the exterior of said latch bolt and wherein the second surface of the first end wall has a post thereon for receiving one end of a coil spring. The spring is adapted to engage the latch bolt normally to bias said beveled end into said guide rail. The opposite end of the coil spring is retained in said housing by the combination of tension from the spring and the presence of a first and second reinforcing walls which are on opposite sides of said spring.

13 Claims, 5 Drawing Sheets

FIG. 4
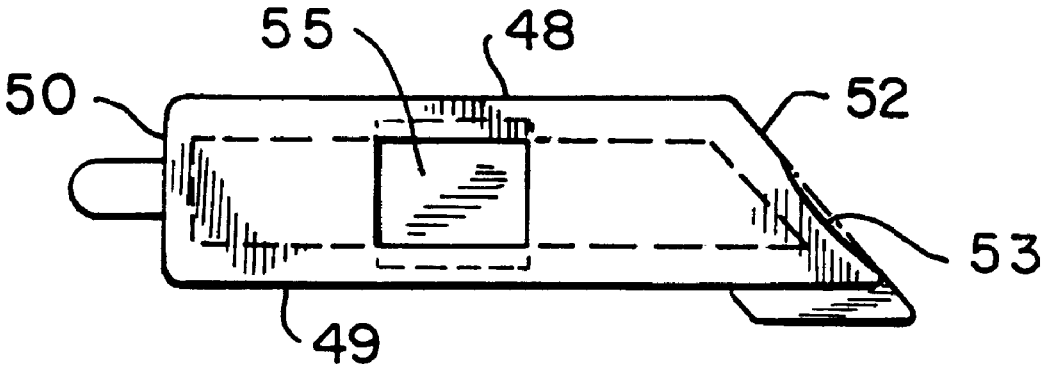
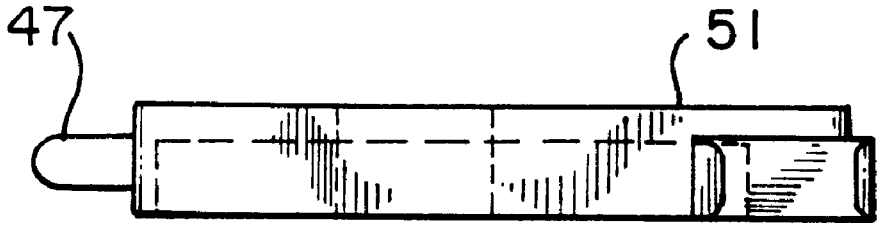
FIG. 5

WINDOW SASH LATCH

The present invention relates to an improved latch mechanism for a pivotal window sash and in particular a mechanism for rotatably removing the sash from the window frame as the window is tilted about the pivoting axis. Pivotal window sashes are typically used in double hung windows, i.e. windows where there are two sashes, an upper and a lower and wherein the sashes are retained in a channel and travel in a vertical direction for opening and closing.

Window cleaning is a not a task that is enjoyed by the typical homeowner. The same is true of painting window frames. In the case of traditional double hung windows the owner of the premises must either clean the windows from the outside of the premises or else lean out of the open window to clean the exterior surface of the window pane. Cleaning the window from the outside is not usually a problem where the window is on the first floor and there is no shrubbery blocking access to the window or where it can otherwise be reached easily without a ladder. Second story windows and higher are another matter. In these instances the homeowner must use a ladder or resort to leaning out from the open window. This latter method raises serious safety concerns since the window frame is not necessarily strong enough to withstand the pressure exerted by the homeowner's weight as he leans against the window sashes to clean their exterior.

The same problems are also encountered with respect to painting windows. Granted, many of today's windows have their exterior clad in an aluminum or vinyl finish that does not normally need painting. However, these finishes can become weathered over time and it is not uncommon for these windows to require a coat of paint from time to time so they retain their attractiveness As a result of these problems with traditional double hung windows, window manufacturers have developed the pivotal sash. A pivotal sash permits the owner of the premises on which the window is installed to tilt the window into the room so it can be cleaned or painted safely and conveniently without the need for ladders or leaning out the window to get those hard to reach spots.

Traditional double hung windows that can only travel vertically and do not pivot usually have a sash latch that includes a curved inclined plane on the top surface of the bottom sash and a retaining means that receives the inclined plane of the sash lock on the top, interior surface of the top sash. The traditional double hung sash latch Inclined plane engages the retaining means positioned on the top sash as the inclined plane is rotated. The traditional sash latch has been replaced on pivotal double hung windows. Pivotal double hung windows usually employ a pair of sash latches on each window sash. One example of this type of sash lock is disclosed in U.S. Pat. No. 4,791,756 to Simpson. The Simpson patent discloses a pair of sash latches mounted internally below the top header of the sash within a channel in the top header. Other examples of latch mechanism for pivotal double hung windows are found in U.S. Pat. No. 5,671,958 to Szapucki, U.S. Pat. No. 5,618,067 to Carlson, U.S. Pat. No. 5,127,685 to Dallaire, U.S. Pat. No. 5,139,291 to Schultz, U.S. Pat. No. 4,837,975 to Simpson, U.S. Pat. No. 5,165,737 to Riegelman, U.S. Pat. No. 4,553,353 to Simpson, U.S. Pat. No. 4,669,765 to Ullman, U.S. Pat. No. 2,768,852 to Hicks and U.S. Pat. No. 3,469,875 to Ahlgren the disclosures of which are incorporated herein by reference.

SUMMARY OF THE INVENTION

The present invention is directed to a pivotal window sash adapted for installation in a master frame of a double-hung sash window assembly. The double hung sash window assembly has opposed, vertically extending guide rails to enable vertical reciprocal sliding movement of the sash in the master frame while the sash is cooperatively engaged with the guide rails. The sash has a header, a base and a pair of stiles cooperatively connected together at adjacent extremities thereof to form a rectangular sash frame. The sash is retained in the guide rails by a manually operable latch adapted that is installed as a preassembled unit in a cut out portion on an exterior surface of the header. The latch releasably secures the sash to the master frame to permit pivotal movement of said sash when the latch is released and vertical movement when the latch is in place.

The latch has a housing having a top wall with an access opening therethrough, a pair of opposing side walls and a single end wall extending between said side walls, each of said side walls and said end wall extend from the top wall and have a free end opposite said top wall. The presence of the free ends on the side walls and the end wall is an important saving in material as the absence of a bottom wall reduces significantly the material costs for manufacturing the latches of the present invention. The present invention has other significant advantages. For example, the latch mechanism sold by MEC and shown in U.S. Pat. No. 5,671,958 to Szapucki has latch bolt with a narrow flange extending from each side of the latch bolt and travels in a slot on each side of the housing. These flanges are made of a thin plastic material that may break off if undue force is placed on the latch bolt during operation of the latch. In addition, the slots in the housing can become clogged with dirt and debris over time thus reducing the functionality of the mechanism. The present invention also has the advantage of being easier to assemble than the prior art latch mechanism particularly the latch mechanisms of the type described in the Ashland patents.

Within the housing is a latch bolt that is slidably received in the housing. The latch bolt has a top wall, two opposing side walls and two opposing end walls. Each of said side walls and each of said end walls extending from said top wall and have a free end opposite said top wall. Just as is the case with the housing, the presence of the free ends on the side walls and the end walls of latch bolt is an important saving in material as the absence of a bottom wall reduces significantly the material costs for manufacturing the latches of the present invention.

The first end wall of the latch bolt is generally perpendicular to each of said side walls, and said second end wall forming a beveled end arranged to be engaged in the guide rail for locking the window sash against pivotal movement. The first end wall has one surface on the interior of the latch bolt and a second surface on the exterior of the latch bolt. The second or exterior surface of the first end wall has a post thereon extending vertically from the end wall for receiving one end of a coil spring. The spring is adapted to engage the latch bolt such that normally the latch bolt is biased so that the beveled end extends into said guide rail.

The opposite end of the coil spring is retained in the housing by the combination of tension from the spring and the presence of first and second reinforcing walls which are on opposite sides of said spring. The latch bolt is retained in the housing be means of a control member. The control member comprises a plate on the exterior surface of the top wall of the housing having a pair of spaced apart members extending from the underside of said plate and passing through the access opening in said housing and an access opening in said latch bolt. The members have a flange on their free end. These flanges retain the housing, the latch bolt and the control member as a unit.

BRIEF DESCRIPTION OF THE DRAWINGS

FIG. A is a representative double hung window assembly which in which the latch assembly of the present invention would be used.

FIG. 4 is a top view of the latch bolt.

FIG. 5 is a side view of the latch bolt of FIG. 4.

DETAILED DESCRIPTION OF THE INVENTION

Figure 3:
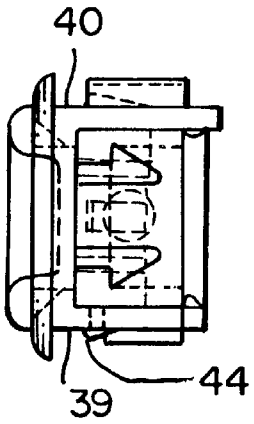
FIG. 3 is a view of the latch of FIG. 1 taken along A—A.
Figure 1:
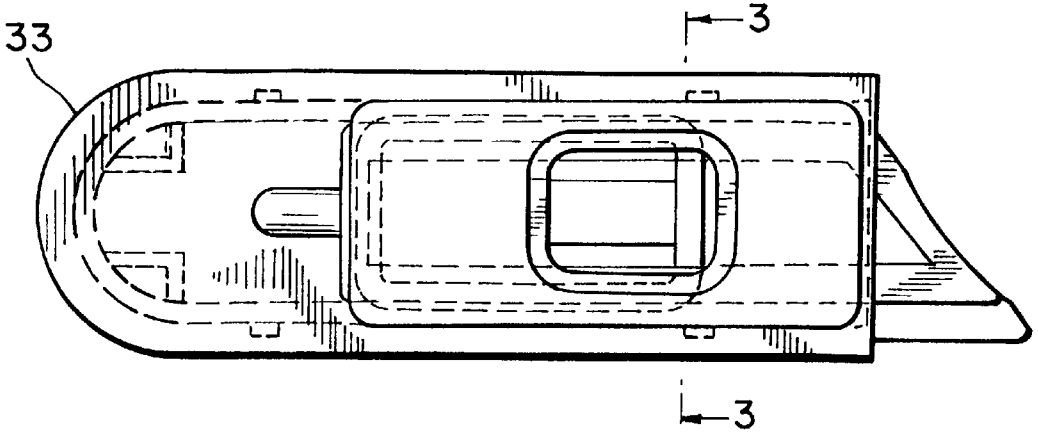
FIG. 1 is a top view of the sash latch of the present invention.

The invention comprises an improved latch mechanism for use with pivotal windows sash in for example, a double hung window assembly. The double hung window assembly typically comprises a frame having a top member 11, a bottom member 12 and two side rails 13. The top member and the bottom member are usually parallel to each other and each of the side rails are also parallel to the other side rail. The two side rails typically have a pair of parallel channels 14 and 15 on their interior surface for retaining a pair of sashes 16 and 17 in place and providing a track for vertical movement of the sashes from a closed position to an open one and vice versa.

Each sash comprises a rectangular frame that surrounds the pane of glass. The rectangular frame is formed by top header 19, a bottom header 20 and two side stiles 21 and 22 that join the top and bottom headers. In many instances the top header, bottom header and the side stiles have mitered edges 23 for a cleaner look. The pair of sashes are retained in the window frame and are reciprocal vertically in guide rails in the frame. In addition to vertical reciprocal travel along the guide rails the windows sash is adapted to pivot about an axis 24 to permit the sash to be tilted in towards a room for cleaning, painting etc. Each of the top header, bottom header and the two stiles have an interior surface 25 that faces into the interior of the building, an exterior surface 26 that faces the exterior, and a pane surface 27 which is adapted to receive a pane of glass.

There is a also a frame contact surface 28 on the stiles and the top surface of the upper sash and the bottom surface of the lower sash. The frame contact surface is usually provided with weatherstripping which may be in the form of a rubber or other flexible material and/or one or more channels that mate with the frame to prevent entrance and egress of air. The bottom surface 29 of the upper sash 30 is on the exterior of the building and the upper surface 31 of the lower sash 32 is on the interior of the building.

The top header of the lower sash is provided with a pair of openings in either the upper surface 31 or the interior surface 25. These openings are adapted to each receive the latch mechanism of the present invention. In FIG. A the openings were present in the upper surface 31 The openings can be U-shaped, rectangular or any other suitable shape. The latch mechanisms are each placed in a cut-out (not shown) in the top header so that the latch bolt can slide into the window frame to retain the sash in position and prevent pivoting. When pivoting is desired the bolt of the sash latch is released from its locking position and the sash is permitted to pivot. The latch mechanism embodying the present invention is generally by reference character 33. The latch comprises a housing 34, a latch bolt 35, a spring 36, and a control means 37 to manipulate or operate the latch. The latch mechanism may be made of any suitable material. One suitable material is a plastic such as nylon, polypropylene, polystyrene, or a polyethylene.

Because of competition among window companies there is significant pressure on latch manufacturers to reduce material costs in the manufacture of sash latches. Although small, four latches are required for each window and as a result, any savings in the amount of material used can provide a competitive advantage in the sale of both the latches and the window they are in. As a result, sash manufacturers seek to reduce the amount of material in the sash latch while at the same time retaining its strength. On important feature of the present invention is the cost saving in the reduced amount of material needed in the manufacture of the latches.

Figure 2:
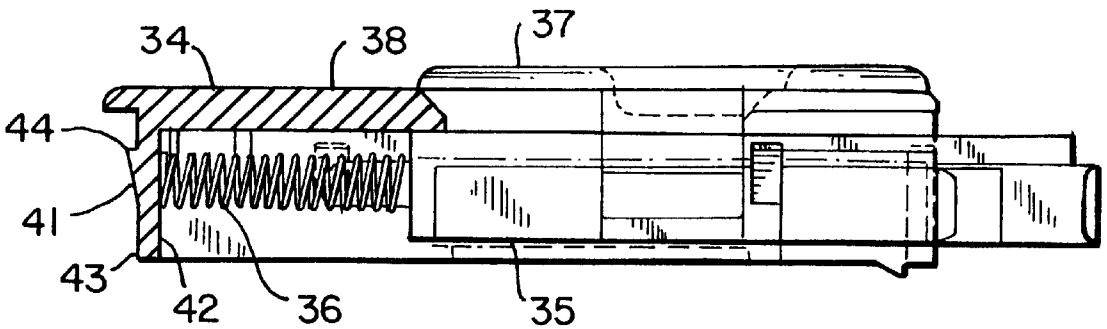
FIG. 2 is a cut away side view of the sash latch of FIG. 1.
Figure 1A:
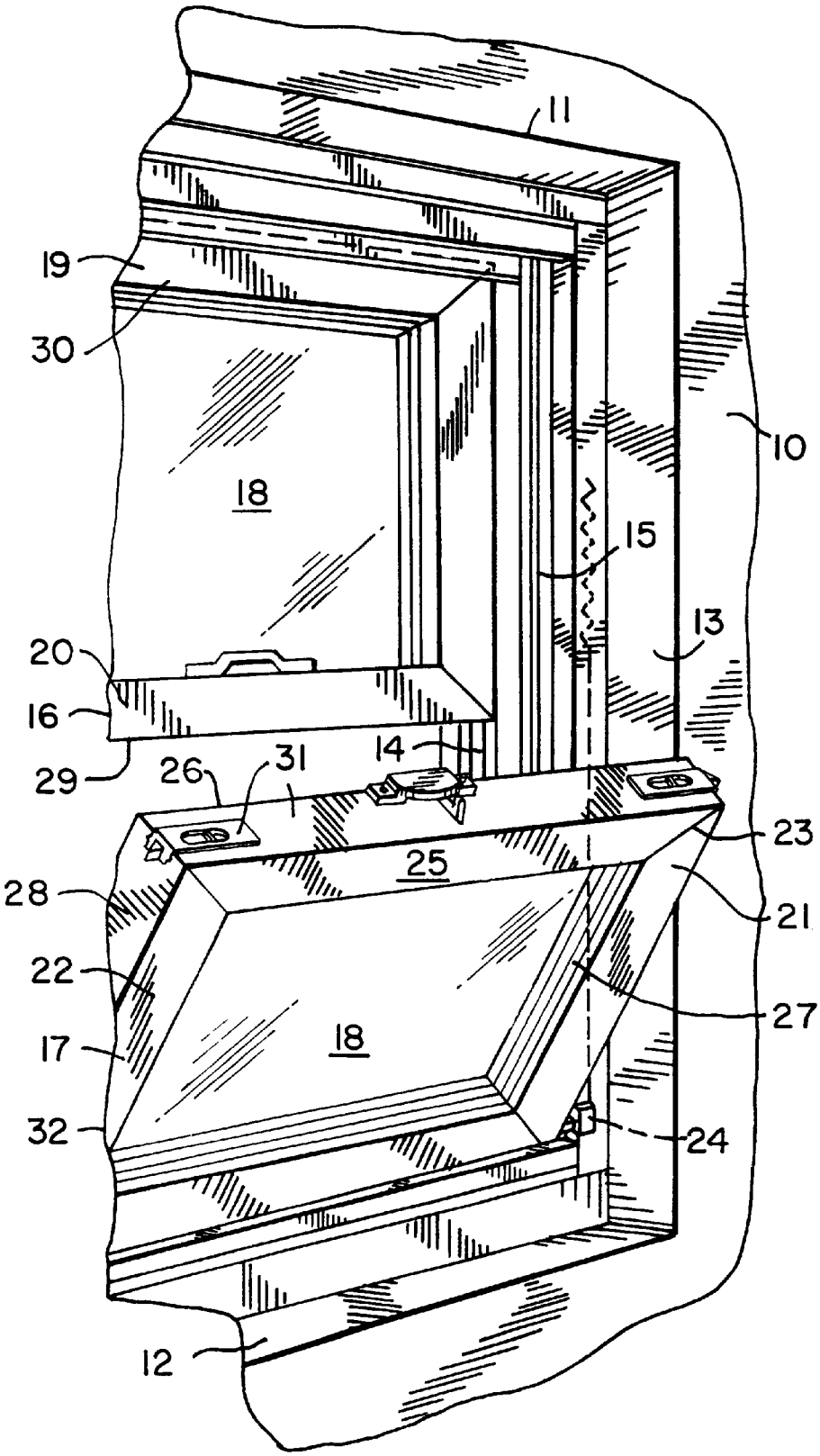
Figure 6:
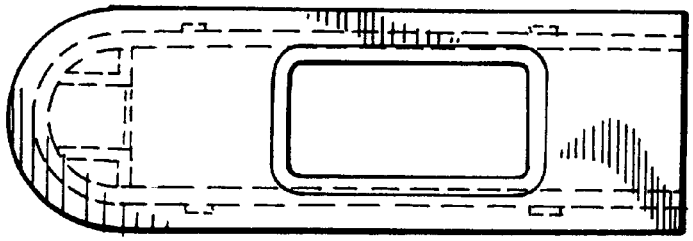
FIG. 6 is a top view of the housing of the sash latch of FIG. 1.
Figure 7:
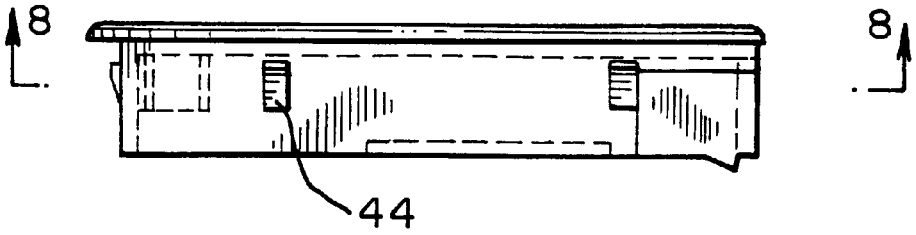
FIG. 7 is a side view of the housing of FIG. 6.
Figure 8:
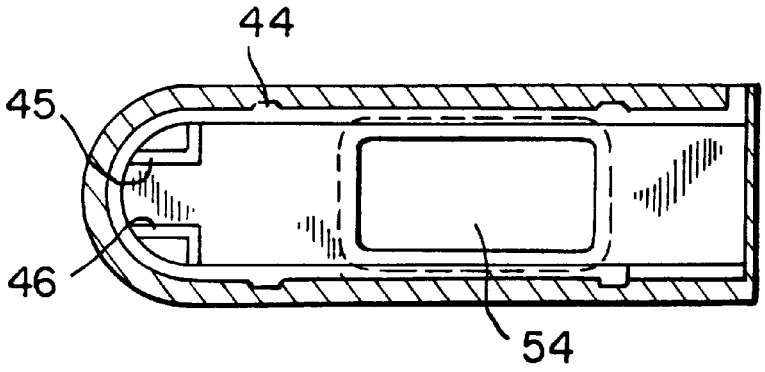
FIG. 8 is a view of the housing taken along B—B.
Figure 10:
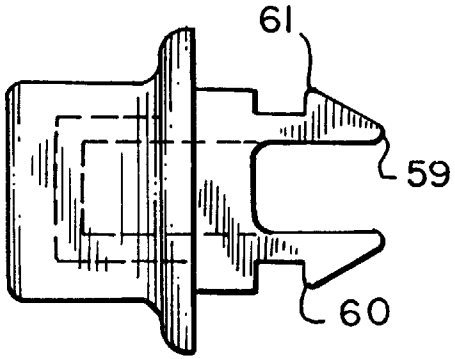
FIG. 10 is a side view of an alternative embodiment of a control member of the sash latch.
Figure 11:
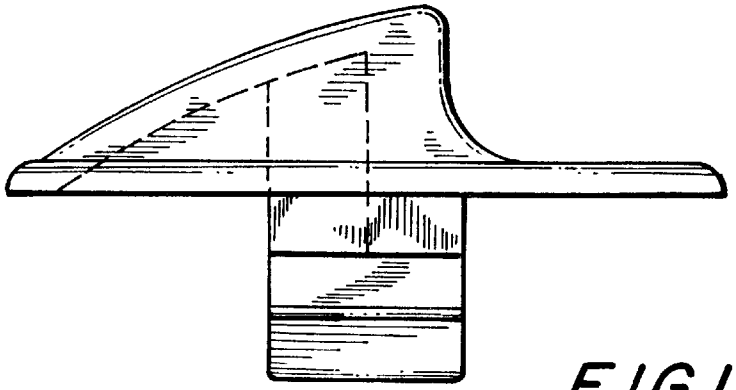
Figure 9:
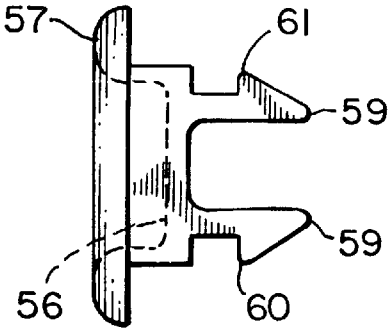
FIG. 9 is a side view of one embodiment of a control member of the sash latch.

The housing has a top or upper surface 38 which is generally flat and which is of a size such that the upper surface covers the cut out opening in the sash. Extending from the underside of the upper surface of the housing are sidewalls 39 and 40. The sidewalls may be joined together by an end wall 41. The sidewalls and the end wall are preferably set back from the edge of the housing as shown in FIG. 3. This provides a means for seating the sash latch properly in the opening of the sash. The end wall may be curved or straight depending on the shape of the opening in the sash. The sidewalls and end wall have an interior surface 42 and an exterior surface 43. On the exterior surface of the sidewalls and the end wall are one or more retaining wedges 44 that hold the sash latch securely in place within the opening of the sash. The retaining wedges have a side profile generally in the shape of a right triangle with one side of the triangle adjacent to the side wall. Another edge of the triangle extends generally horizontally from the side wall, generally at a right angle thereto. The triangular retaining wedge tapers downwardly, becoming narrower as it extends away from the side of the triangle extending horizontally from said side wall. The number of retaining wedges on the sidewalls and the end wall will depend on the size of the sash latch. Preferably, there should be at least one wedge on the end wall preferably at the center thereof. Along the sidewalls, there should be at least one and preferably two or more retaining wedges Extending generally perpendicularly from the inside of each of the side walls and the end wall are preferably a pair of reinforcement walls that meet to form a generally right angle. The reinforcement walls need not extend the entire distance from the inside top of the latch to the bottom surface of the latch. As shown in FIG. 2 the reinforcement walls extend about one half the distance from the inside top of the latch to the bottom surface. The reinforcement walls provide a means for retaining one end of a coil spring in position in the mechanism without the spring coming loose. The other end of the coil spring is slipped over a post 47 extending from the rear surface of the latch bolt. The latch bolt 35 is generally in the form of a trapezoid with the long sides 48 and 49 being generally parallel and connected to each other by rear wall 50 that is preferably generally perpendicular to each of the two long sides. The upper surface 51 of the latch bolt is generally planar as is the underside of the housing to permit smooth movement of the latch. The latch nose 52 is preferably angled or beveled to permit the latch to travel into the frame to retain the sashes in the vertical position even if the sash is slightly out of alignment. In addition, in a preferred embodiment, the latch nose has a slight undulation 53 which is shaped almost like an exaggerated "S" on its side. The purpose of the undulation is to ease insertion of the latch nose into the window frame.

The latch bolt is held in position in the housing by the control means. The housing has an access opening 54. Similarly, the latch bolt also has an access opening 55. The control means 37 has a plate 57 and may have a recessed portion 56 on its upper surface for receiving a finger so that the control means may move the latch bolt. On the under side of the control means there are a pair of members 58 and 59 extending from the underside. At the free end of the members there are flanges 60 and 61. The members pass through the access openings in the housing and the latch bolt and with the flanges retain the control means, housing and latch bolt as a unitary assembly. The flanges may preferably face each other or face the side walls of the housing. If desired, instead of a recessed portion, the control means may have a raised portion 62. Because the control means retains the housing and latch bolt together as a unitary assembly there is no need for the housing or the latch bolt to be provided with a base this provides a significant reduction in material costs for the latcheds of the present invention compared to conventional latch mechanisms.

I claim:

1. In a pivotal window sash adapted for installation in a master frame of a double-hung sash window assembly having opposed, vertically extending guide rails to enable vertical reciprocal sliding movement of the sash in the master frame while cooperatively engaged with the guide rails, the sash having a header, a base and a pair of stiles cooperatively connected together at adjacent extremities thereof to form a rectangular sash frame; a manually operable latch adapted to be installed as a preassembled unit in a cut out portion on an exterior surface of the header for releasably securing said sash to said master frame to permit pivotal movement of said sash, said latch comprising:

a housing having a top wall having an access opening therethrough, a pair of opposing side walls and a single end wall extending between said side walls, each of said side walls and said end wall extending from said top wall and having a free end opposite said top wall, said walls having an interior surface and an exterior surface;

a latch bolt slidably received in said housing and having a top wall, two opposing side walls, two opposing end walls, each of said side walls and each of said end walls extending from said top wall and having a free end opposite said top wall, said first end wall being generally perpendicular to each of said side walls, and said second end wall forming a beveled end arranged to be engaged in a guide rail for locking the window sash against pivotal movement, said first end wall having one surface on the interior of the latch bolt and a second surface on the exterior of said latch bolt and wherein said second surface of said first end wall has a post thereon for receiving one end of a coil spring, said spring adapted to engage said latch bolt normally to bias said beveled end into said guide rail;

the opposite end of said coil spring being retained in said housing by the combination of tension from the spring and the presence of a first and second reinforcing walls which are on opposite sides of said spring;

said latch bolt being retained in said housing by means of a control member, said control member comprising a plate on the exterior surface of the top wall of said housing, said plate having a pair of spaced apart members extending from the underside of said plate and passing through the access opening in said housing and an access opening in said latch bolt, said members having on their free end a flange, said flanges retaining said housing, said latch bolt and said control member as a unit.

2. The window sash according to claim 1 wherein the reinforcing walls comprise a first member extending from said side wall of said housing and a second member extending from the end wall of said housing.

3. The window sash according to claim 2 wherein said first member and said second member form a right angle where they meet.

4. The window sash according to claim 3 wherein the reinforcing walls extend from the interior surface of said top wall.

5. The window sash according to claim 4 wherein said latch bolt is being retained in said housing substantially solely by said control member.

6. The window sash according to claim 5 wherein each of said flanges face the nearest sidewall.

7. The window sash according to claim 6 wherein said beveled end has a undulating surface.

8. The window sash according to claim 1 wherein said latch bolt is being retained in said housing substantially solely by said control member.

9. The window sash according to claim 1 wherein each of said flanges face the nearest sidewall.

10. The window sash according to claim 1 wherein said beveled end has a undulating surface.

11. The window sash according to claim 1 wherein the exterior surface of at least one of said end wall and said side walls of said housing have at least one retaining wedge.

12. The window sash according to claim 11 wherein said retaining wedge is in the form of a triangle.

13. The window sash according to claim 12 wherein the triangular retaining wedge tapers downwardly, becoming narrower as it extends away from the top wall of the housing.

* * * * *